US005282283A

United States Patent [19]

Atkin

[11] Patent Number: 5,282,283

[45] Date of Patent: Feb. 1, 1994

[54] URINATION STATION

[75] Inventor: Irving Atkin, Winthrop, Mass.

[73] Assignee: Mr. Tux, Inc., Winthrop, Mass.

[21] Appl. No.: 906,521

[22] Filed: Jun. 30, 1992

[51] Int. Cl.[5] ..... A47K 17/02

[52] U.S. Cl. ..... 4/661; 4/301; 40/630; 40/636

[58] Field of Search ..... 4/661, 301, 449, 254; 40/630, 636, 638

[56] References Cited

U.S. PATENT DOCUMENTS

| | | | |
|---|---|---|---|
| 3,034,151 | 5/1962 | Fillqung | 4/301 X |
| 3,657,745 | 4/1972 | Hickman | 4/483 |
| 5,123,130 | 6/1992 | Sanders | 4/661 |

FOREIGN PATENT DOCUMENTS

| | | | |
|---|---|---|---|
| 0761119 | 3/1934 | France | 4/254 |
| 0839936 | 4/1939 | France | 4/254 |
| 0588561 | 2/1959 | Italy | 4/449 |

*Primary Examiner*—Charles E. Phillips
*Attorney, Agent, or Firm*—Robert M. Asher

[57] ABSTRACT

A urination station with a pair of foot mats straddling a urinal basin. Each mat accommodates a foot at a height from the floor which discourages the user from stepping partially on a mat and partially on the floor. Each mat has an adhesive layer which fixes it in position on the floor.

11 Claims, 2 Drawing Sheets

URINATION STATION

BACKGROUND OF THE INVENTION

The present invention is directed to urination stations that include positioning mats used in conjunction with urinals.

Mens' lavatories are generally equipped with urinals mounted against a wall. The basin of the urinal may either be raised or may sit on the floor. It has been found that in man public restrooms, that some men have a tendency to stand back away from the urinal while urinating. As a result, urine will often drip onto the floor in front of the urinal basin. This result in unsanitary conditions that can be relieved only through frequent cleanings.

It is an object of the present invention to provide a urination station at which men are encouraged to properly position themselves over the urinal basin so that all of the urine goes into the urinal basin and stays off the floor.

SUMMARY OF THE INVENTION

In accordance with the present invention, a pair of foot mats are fixed to the floor, straddling the basin of the urinal. The positioning is such that a person standing on the foot mats is properly positioned with respect to the urinal basin. The foot mats are made high enough so that it would be awkward to stand in a position partially off the mats and away from the urinal due to the difference in levels between the foot mat and the floor. The foot mats have a self-sticking adhesive layer which adheres the mat to the floor in the proper position.

The present invention advantageously encourages more sanitary conditions in mens' lavatories.

DETAILED DESCRIPTION OF THE PREFERRED EMBODIMENTS

Figure 1:
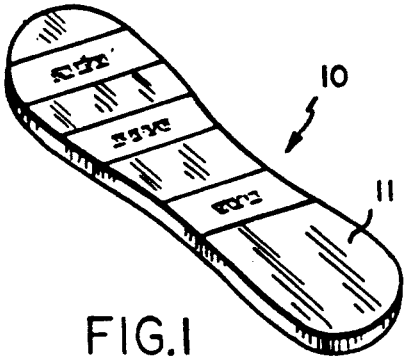
FIG. 1 is an isometric view of a positioning mat of the present invention.
Figure 2:
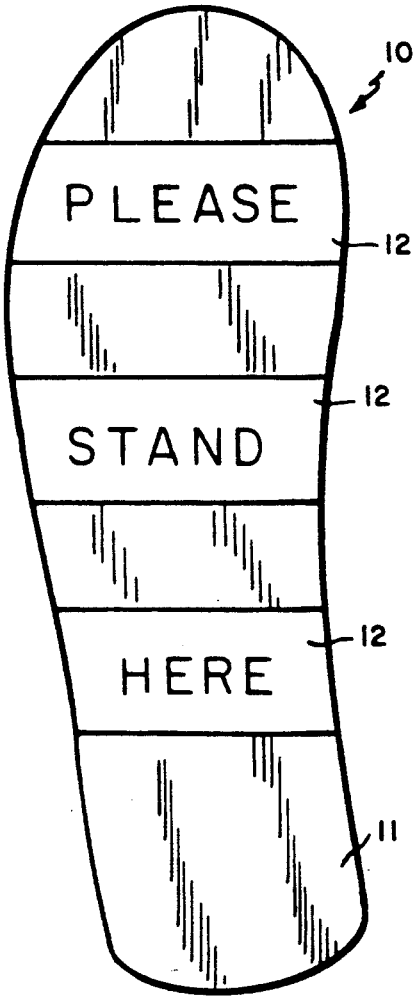
FIG. 2 is a plan view of the foot positioning mat of FIG. 1.
Figure 3:
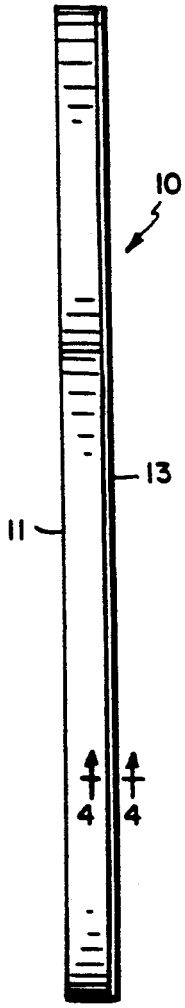
FIG. 3 is a side view of the foot positioning mat of FIG. 1.
Figure 4:
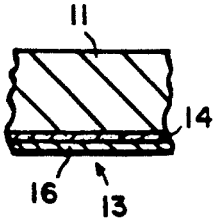
FIG. 4 is an expanded cross-sectional view taken along lines 4—4.

Referring now to the drawings, a first embodiment of the foot positioning mats for use in the urination station of the present invention are shown in FIGS. 1–4. The floor mat 10 has a flat top side 11 and a flat bottom side 13. The size of the mat is made so that an average shoe can comfortably fit on top thereof. The floor mat is made of a non-porous rubber such as ethylene vinyl acetate. The top side of the mat preferably provides a slip resistant surface. The top side of the floor mat is provided with an inscription 12 designed to instruct users of the urinal of how to use the mats. For example, the inscription "Please Stand Here" may be used to properly instruct the user. The bottom side of the floor mat is coated with a self-sticking adhesive layer 14. This should preferably be a waterproof adhesive with extra high tack to prevent the mat from lifting off or sliding on the floor.

Prior to installing the floor mat in positions straddling a urinal, the mat is provided with a release sheet 16 covering the adhesive layer 14. The release sheet 16 would be removed upon installation of the mats in position at the urinal. The floor mat 10 may be shaped as the sole of a shoe. For example, a man's size 11 shoe sole may be the model for the size and shape of the mat. In using shoe soles to shape the foot mats, a left sole-shaped mat and a right sole-shaped mat may be used to correspond to the left and right foot. Each sole-shaped mat has a forefoot portion and a heel portion. A left mat would have a forefoot portion that is wide to accommodate the ball of a foot and curved to the right to accommodate the shape of a foot. The opposite curves are used in a right foot mat. The thickness of the mats 10 are made large enough so that a person stepping partially on the floor and partially on the mat would be in a less than comfortable position. The presently preferred mats 10 are ¾ of an inch thick.

Figure 5:
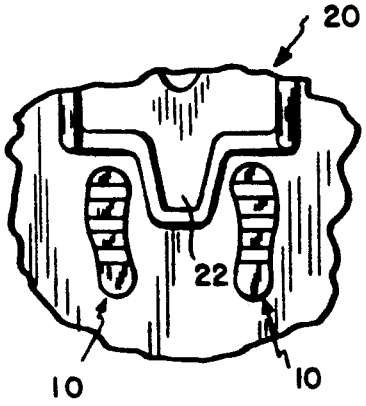
FIG. 5 is a plan view of a urination station of the present invention with the basin on the floor.

In FIG. 5, a urination station in which the basin is seated in the floor of a lavatory is shown. The urinal basin 20 includes a central extended portion 22 to catch dripping urine. Two foot mats 10 straddle the basin 20. The foot mats 10 are fixed in position by their adhesive layer 14 which holds the mats in position on the floor. The forefoot portion of each mat 10 is placed beside the central extended portion 22 of the basin 20. The heel portions are back away from the urinal basin but have a back edge that is close enough to the urinal so that urine dripping from a man standing with his heels on the heel portions will tend to fall in the basin.

Figure 6:
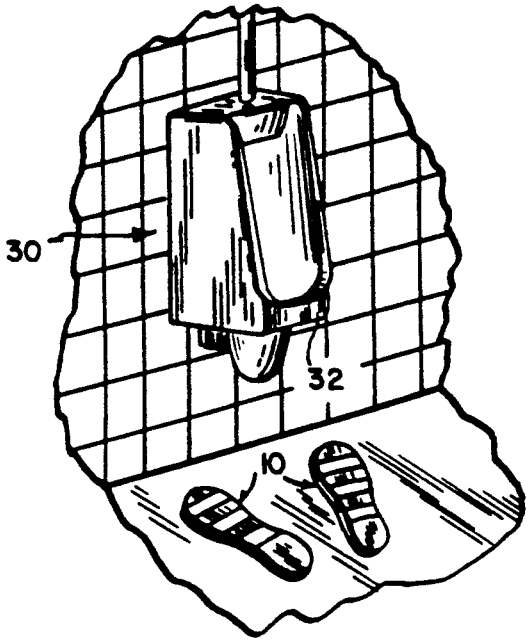
FIG. 6 is an isometric view of a urination station of the present invention with a wall-mounted urinal.
Figure 7:
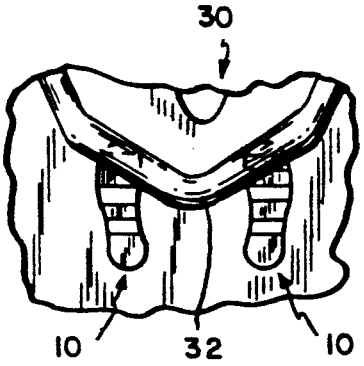
FIG. 7 is a plan view of the urinal set up of FIG. 6.

FIGS. 6 and 7 show a urination station in which the urinal 30 is a wall mounted unit. As such, there is more room on the floor for positioning the mats 10. The mats 10 straddle the center of the basin so as to be about equidistant from a center front edge 32 of the basin. The forefoot portions of the foot mats may be located directly beneath the basin of the urinal 30. The back edge of the foot mats should be positioned so that a person with his heels just touching the back edges is appropriately positioned with the front of their body above the outermost center front edge 32 of the urinal basin 30 The presently preferred measurements are to provide the back edges at about 6 inches back away from a line tangent to the center front edge 32 of the basin. The pair of foot mats are placed apart from one another about 12 inches from center to center. The footmats may be sold in conjunction with a spacer or template for placement between the mats during installation to easily set the mats a predetermined distance apart.

Persons who generally stand away from the urinal during urination will be discouraged from doing so with the urination stations of the present invention. The back edges of the floor mats are sufficiently away from the urinal so that if one was to stand behind the floor mats, he would be so far away as to feel relatively uncomfortable. For the person to move forward to their habitual position away from the urinal is further made uncomfortable because of the difference in heights between the floor mat and the floor. To avoid this discrepancy in height, a user is encouraged thereby to stand on the mats and therefore be properly positioned straddling the center front extended portion of the urinal.

Figure 8:
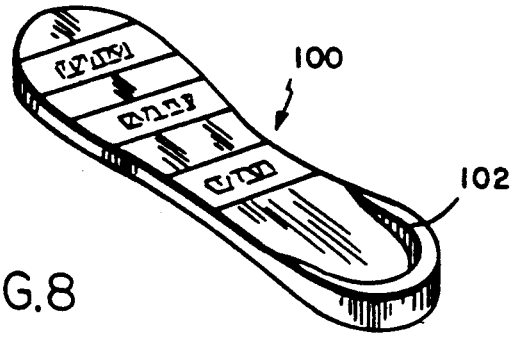
FIG. 8 is an isometric view of an alternate embodiment of a foot positioning mat of the present invention.

The foot mats of the present invention may be further enhanced by making the back edges thicker than the forefoot portion. This may be accomplished by providing a slant in the mat through a gradually increasing thickness from front to back. The extra elevated back edge would provide additional discouragement to standing partially on and partially behind the mats. An alternate embodiment for providing an extra elevated back edge is shown in FIG. 8. The foot mat 100 of FIG. 8 includes a raised heel edge 102. The raised heel edge 102 is provided along the circumference of the mat in the heel portion. It is a wall which provides extra height so as to make it even more awkward for a person to stand partially on the mat and partially off the mat. It would thus tend to further encourage a person to properly stand within the mat with the heel against the raised heel edge 102.

In accordance with the urination stations of the present invention, a person standing on the floor mats 10 properly straddles the urinal basin so that substantially all of the urine falls into the basin.

Though the embodiments described and disclosed above are preferred, other embodiments and refinements which do not part from the true spirit and scope of the present invention may be conceived by those skilled in the art. It is intended that all such embodiments and refinements be covered by the following claims.

I claim:

1. A urination station comprising:

a urinal mounted against a wall, said urinal having a basin with a center front edge, a splash wall extending down into the basin and side walls on both sides of the splash wall extending up from said basin; and a pair of mats adhered to a floor each approximately an equal distance from the center front edge of said urinal, each of said mats having a top surface and a bottom surface defining therebetween a mat thickness, each mat further including a forefoot portion positioned in the direction of said urinal and a heel portion, narrower in width than the forefoot portion, positioned away from the urinal so that a user facing said urinal standing with one foot on each of said mats straddles the center front edge of said urinal wherein a user stepping partially on said mat and partially on said floor would experience a sensation alerting him of an improper body position with respect to said urinal.

2. The urination station of claim 1 wherein said pair of mats includes a left sole-shaped mat and a right sole-shaped mat.

3. The urination station of claim 1 wherein each of said mats is made of a non-porous rubber.

4. The urination station of claim 1 wherein each of said mats is made of ethylene vinyl acetate.

5. The urination station of claim 1 wherein said pair of mats is adhered to the floor with a self-sticking waterproof adhesive.

6. The urination station of claim 1 wherein each of said mats bears an inscription on the top surface thereof including the words "Please Stand Here".

7. The urination station of claim 1 wherein the top surface of each of said mats is elevated at least ¾ of an inch above the floor.

8. The urination station of claim 1 wherein for each of said mats, the back edge of the mat is more elevated than the front portion of the mat.

9. The urination station of claim 1 wherein said urinal is mounted in suspension over a floor.

10. The urination station of claim 9 wherein a section of the forefoot portion of each of said mats is position directly below a portion of the basin of said urinal.

11. The urination station of claim 1 wherein the basin of said urinal extends down into the floor.

* * * * *